United States Patent [19]

Gaudio

[11] Patent Number: 4,667,183

[45] Date of Patent: May 19, 1987

[54] KEYBOARD HOLD-DOWN FUNCTIONS FOR A MULTI-ZONE INTRUSION DETECTION SYSTEM

[75] Inventor: Raymond J. Gaudio, Babylon, N.Y.

[73] Assignee: Napco Security Systems, Inc., Copiague, N.Y.

[21] Appl. No.: 774,489

[22] Filed: Sep. 9, 1985

[51] Int. Cl.[4] ..... G08B 23/00; E05B 45/06

[52] U.S. Cl. ..... 340/501; 340/514; 340/527; 340/528; 340/543; 340/365 S; 340/63

[58] Field of Search ..... 340/501, 514, 527, 528, 340/541-543, 365 R, 365 UL, 365 S, 365 E, 63

[56] References Cited

U.S. PATENT DOCUMENTS

| | | | |
|---|---|---|---|
| 3,978,478 | 8/1976 | Schmitz | 340/528 |
| 4,114,147 | 9/1978 | Hile | 340/543 |
| 4,463,340 | 7/1984 | Adkins et al. | 340/543 |
| 4,498,075 | 2/1985 | Gaudio | 340/524 |

*Primary Examiner*—Donnie L. Crosland
*Attorney, Agent, or Firm*—Arthur L. Plevy

[57] ABSTRACT

An intrusion detection system of the type employing a keypad utilizing the keys to conventionally enable a user to key in a secret code capable of arming or disarming the system. The present apparatus includes a hold-down feature whereby if any one of the plurality of keys on the keypad is depressed for a predetermined interval, the apparatus detects the predetermined timing interval and transmits an audible sound to the user indicating that the requisite timing interval has transpired. Upon receipt of the audible sound, as depending upon the test to be performed, the user is thus informed that the system will now commence the test procedure as defined by the selected key. Thus the system includes apparatus for detecting the requisite timing interval. Upon detection of the requisite timing interval a storage means is activated, which storage means is associated with the selected key. Upon activation of the storage means, the output of the storage means is directed to the intrusion system whereby the intrusion system is now programmed to undergo the test procedure or operating procedure which is defined by the selected key as depressed for the requisite timing interval.

20 Claims, 2 Drawing Figures

KEYBOARD HOLD-DOWN FUNCTIONS FOR A MULTI-ZONE INTRUSION DETECTION SYSTEM

BACKGROUND OF THE INVENTION

This invention relates in general to keypads employed in intrusion systems and more particularly to a hold-down function for such a keypad utilized in a multi-zone intrusion system.

The prior art is replete with many different intrusion systems which operate to monitor premises and to transmit suitable warnings for the occurrence of a break-in attempt such as a burglary or to monitor other conditions such as fire, smoke and so on. These systems have been generally referred to as intrusion systems or intrusion detection systems and essentially provide an alarm when an unauthorized condition exists on the premises being monitored.

In regard to such systems as presently employed, a central alarm may monitor many zones associated with a given location. For example, in a factory or office complex a central alarm may be used to indicate an unauthorized condition which exists in one or more locations. It is, of course, an object of such a central alarm system to indicate to a user which of the particular zones is associated with the unauthorized condition. As such, such systems have an alarm panel, which alarm panel in modern systems includes a keypad. The keypad is relatively conventional and is the type of keypad which is, for example, used on a conventional telephone subset. The function of the keypad in most systems is to allow the user to arm or disarm the system. Hence, a user will preprogram the system to accept a unique code which is a secret code. This code is then impressed into the system via the keypad to allow the user to gain access to the premises being monitored by the system.

In this manner the secret code is used to set or reset the system on a daily basis. This eliminates the need for complicated key mechanisms and other devices utilized in the prior art. The use of such keypads has been extensively employed in intrusion detection systems and in combination with alarm panels. See for example U.S. Pat No. 4,498,075 which issued on Feb. 5, 1985 entitled FAULT INDICATOR APPARATUS FOR A MULTI-ZONE INTRUSION SYSTEM by Raymond Gaudio and assigned to Napco Security Systems, Inc., the assignee herein.

The patent describes an indicator system for an intrusion system employing a keypad alarm panel. It is, of course, apparent that there is a separate need in conjunction with such systems to allow a user or installer to perform various tests to determine whether the system is operating correctly as well as to perform various system checks to determine, for example, which zones have been violated and to gain other information regarding the system operation.

As indicated above, the prior art utilized the keypad mainly for the purpose of arming or disarming such a system via the impression of a secret code known only to the user or those who are authorized to enter or leave the premises. The present invention utilizes the keypad as a means of accessing the system for test purposes and can utilize the keypad in a separate distinct mode whereby if a key is held down or depressed for a predetermined period, the system will recognize and implement a test mode or a mode in which various system parameters and operating conditions can be checked.

Thus, as will be explained, the keyboard now performs dual functions enabling greater flexibility and versatility in regard to such systems.

BRIEF DESCRIPTION OF THE PREFERRED EMBODIMENT

A key hold-down apparatus for use in an intrusion detection system of the type employing a keypad consisting of a number of activatable keys for keying in information to said system indicative of a code for arming or disarming said system, the combination therewith comprising timing means coupled to said keys and operative to commence a predetermined timing cycle upon depression of any one of said keys, means coupled to said timing means and responsive to the termination of said timing cycle to provide an indication of the same, logic means coupled to said timing means and responsive to the termination of said timing cycle to provide an output control signal indicative of the key depressed during said interval and including means responsive to said control signal to activate said intrusion system to operate in a mode determined by said depressed key.

DETAILED DESCRIPTION OF THE INVENTION

Figure 1:
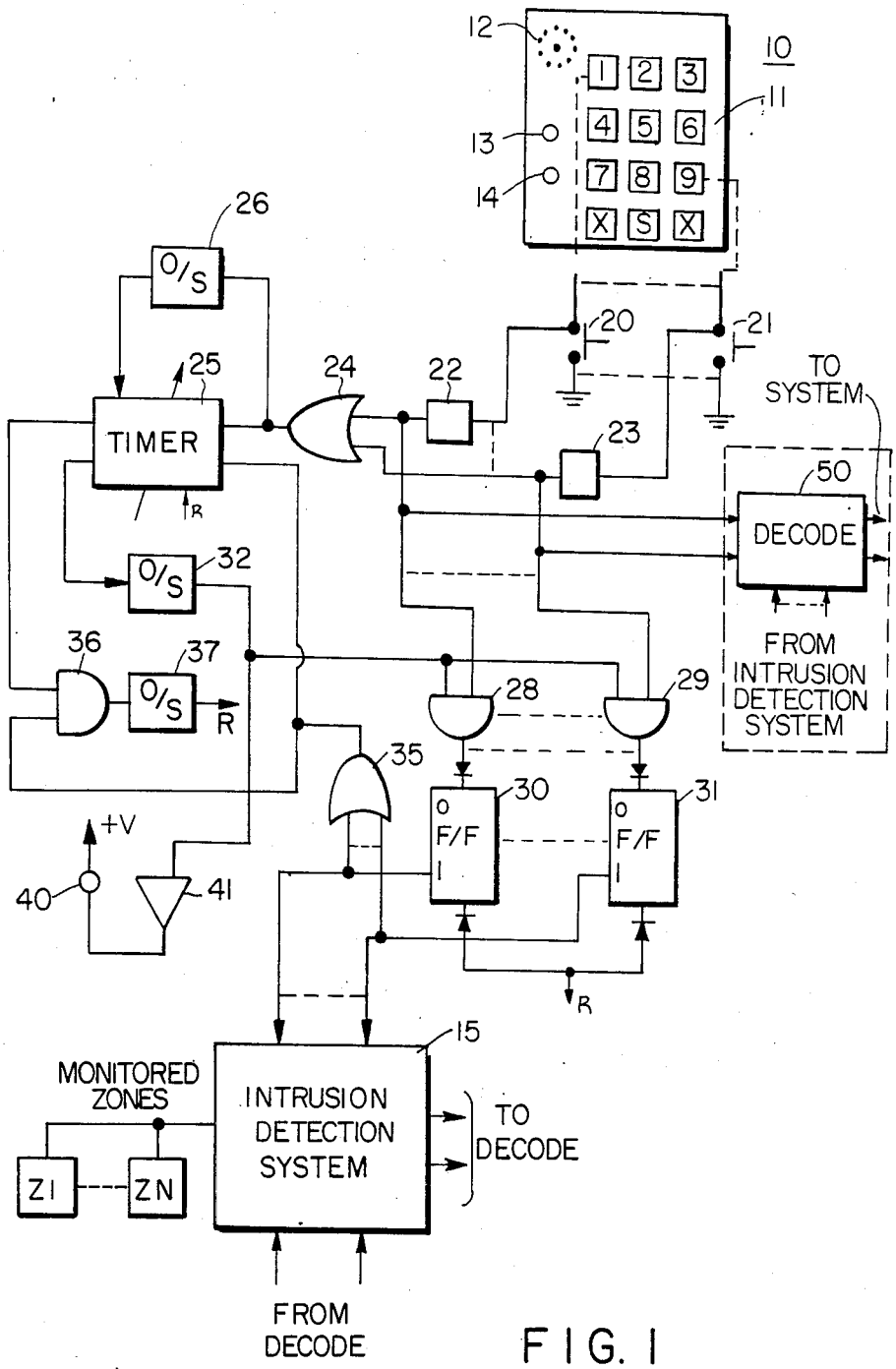
FIG. 1 is a detailed block diagram depicting a keypad hold-down apparatus according to this invention.

Referring to FIG. 1, there is shown a block diagram of a keypad hold-down system according to this invention.

There is shown a typical control alarm panel 10. The panel 10 contains a telephone-like keyboard or keypad 11 which is employed by a user to key in a secret or memorized number operative to arm or disarm the intrusion system. For example, in a multi-zone system a number of different areas, for example six, are monitored by separate sensing devices such as intrusion detectors as windows, door switches, vibration detectors and so on.

When the system 15 is to be placed in operation, the user would key in the proper number via keypad 11, and if all zones are secured the armed light 13 would go on or illuminate. However, if any zone as zone Z1 to ZN associated with the detection system 15 is not secured, as a door or window being left open, then this is an actual alarm condition, and arming the system would cause an alarm to go off. Thus, when the system is not armed or disarmed, it is imperative that the user know which of the zones is not secure to enable him to take the proper steps to see that the zone is secured prior to arming the system. This is explained in great detail in the above-noted patent, U.S. Pat. No. 4,498,075.

As seen in FIG. 1, the alarm control panel 10 is also associated with a speaker 12 to enable the user to receive audible tones, as will be explained, to inform him that a test mode has been accessed via the keypad 11. This is an optional feature which can be employed only on some tests. On other tests the audible feedback may not be necessary. As will now be explained, the hold-down function of the keypad is associated with the following modes of operation. Essentially, each separate key as keys 1 through 9 can be accessed by a user, and if the key is held down for a predetermined interval, the system will automatically recognize the fact that the key has been held down for this interval and initiate a given test or check mode, which mode is selectively associated with each key. Hence as will be explained, each key is indicative of performing a different system test operation or a system check operation, which operation is implemented by the holding down of a given key for a predetermined time interval.

As can be seen from FIG. 1, the keypad comprises 12 keys which accommodate the digits 1 through 9 as well as digit 0 plus an additional two keys which are supervisory keys and can be utilized for other functions. Each key associated with the keypad 11 constitutes a momentary operated switch to enable a user to access the keypad and for example depress the keys in sequence according to the authorized code or secret number as described above.

For the sake of clarity, two of the key switches as 20 and 21 are shown. Key 20 is associated with digit number 1 of the keypad 11 while switch 21 is associated with digit 9 of the keypad 11. As shown in the Figure, each switch as 20 and 21 is a momentary operate switch, and upon depressing the switch a momentary action is peformed. As indicated, such keypads as well as switches are well known in the state of the art, and many examples of keypads are available from many manufacturers and are in widespread commercial use. Each key as 20 and 21 is associated with an anti-bounce circuit as shown in block form as 22 and 23. Such circuits may consist of an RC network or an integrating network to debounce the key. This is well known in the digital field and many such debouncing circuits are known. The function of a debouncing circuit as 22 and 23 is to prevent multiple pulses to be provided upon operation of a key.

Essentially, the outputs of each key as 20 and 21 are directed to multiple inputs of a common OR gate 24. The OR gate 24 has its output connected to the input of a timing circuit 25. The timing circuit 25 may consist of a binary counter which is activated by a clock and which will count up for a predetermined selected period. After the predetermined period has expired, a decode gate will decode the output of the counter to determine specified timing intervals. The counter is shown in block form and has an arrow associated with the same indicating that the timing sequence or timing interval can be changed as by changing the decode gates.

As indicated, while the timer 25 is preferably a digital circuit, it can be implemented by many analog timing circuits as well. Thus, upon depression of a particular switch as 20 or 21, the OR gate 24 is activated and produces an input signal to the timing circuit 25 which enables a timing interval to commence. Also shown coupled to the output of OR gate 24 is a one shot or monostable multivibrator 26. The function of the multivibrator 26 is to reset the timer each time a switch is depressed for a shorter period such as, for example, when a user is punching in the secret code.

The one shot 26 is responsive to, for example, the trailing edge of a key activation as for example when a key is depressed and then released. In this manner the one shot 26 will continuously reset the timer during normal keyboard operation. When the hold-down function is desired, the user is required to hold down a key indicative of a test procedure for a predetermined interval determined by the timing interval provided by the timer 25. Each key as 20 and 21 is also associated with an AND gate as gates 28 and 29 where the output of the AND gate is associated with a separate flip-flop as flip-flops 30 and 31.

As will be explained, the function of the flip-flops 30 and 31 is to implement a different test mode when a key has been actuated for the predetermined time interval. The output of the timer 25 has one lead coupled to the input of a one shot or monostable multivibrator 32. The output of the multivibrator 32 is directed to suitable inputs of AND gates 28 and 29 which, as will be explained, activate the associated flip-flops as 30 and 31 for the depression of keys 20 and 21.

The flip-flops 30 and 31 are activated or triggered via gates 28 and 29 after the predetermined time interval as determined by timer 25 has been implemented. The outputs of the flip-flops—namely, the high or low outputs, are all coupled to inputs of an OR gate 35, which gate 35 operates to control the timer 25 as will be explained. The output of the timer 25 is also coupled to one input of an AND gate 36 having its other input coupled to the output of OR gate 35. The AND gate 36 produces a reset pulse by the triggering of a one shot 37 to reset the circuitry after a test mode operation is performed. The output of one shot 32 is also applied to a gating amplifier 41 having an output coupled to a speaker 40 which is positioned on the alarm control panel 10 beneath speaker 12.

The component 40 may be a typical ceramic speaker or other device which will receive the pulse from the one shot 32 via amplifier 41 and convert the pulse to an audible one which can be heard by the user via the speaker 12 located on the keyboard. The system briefly described above operates as follows.

As was explained above, each of the digit keys associated with the control panel 10 have and can perform a second function. This is called and referred to as a holdout function. Holdout functions for each key may be labeled on the keypad cover plate or be included in the instruction manuals with the intrusion system. Essentially, to use any digit key's second function, the key should be held down for an approximate period equal to the period afforded by timer 25. This period may typically be two seconds or more which will enable the system to detect a hold-down request as apart from a normal keying-in function such as that performed by a user in arming and disarming the system.

While each key can be associated with a hold-down function, it is understood that less than all keys, or for example one or two keys, may be associated with hold-down functions while the other keys may not. For purposes of explanation let us now assume that there is a hold-down function associated with key 1 and that is a test function. In intrusion systems a backup is provided in the case of power failure. Thus such systems normally include a standby battery, which battery will be switched into operation if there is a power failure. In any event, the standby battery test is normally performed by a technician actually going into the circuitry and measuring battery voltage to determine whether the battery is of proper voltage or whether the battery has been charged properly.

The following standby battery test is one example of a test which can be implemented by the hold-down system described. Hence the user will be notified that by holding down the digit key 1 associated with the keyboard 11 one can perform a battery check test. The user will hold down the momentary switch associated with digit 1 until he hears a bleep. Upon hearing the bleep, the intrusion detection system will sound an audible alarm device (such as a siren) while the control center is powered by the standby battery. If no alarm sound is heard or if the alarm sound is weak, the battery may need recharging or replacement, and hence the user would be informed of this factor during the hold-down test function.

Circuit operation is as follows. First assume that the user wishes to perform the hold-down function as provided by digit key 1 as explained. The consumer will then depress key 1 which is associated with momentary switch 20. Upon depression and holding down of momentary switch 20, the OR gate 24, as indicated, will activate the timer 25 which will continue a timeout operation only if the key remains held down. The timer 25 will then commence its timing interval. At the end of the preset timing interval which may, for example, be between two to five seconds, the timer 25 will produce an output pulse via a suitable decode gate, which output pulse will trigger the one shot 32.

Since key 1 is depressed, gate 28 will respond to the output pulse from the one shot 32 and thus trigger flip-flop 30 into its active state. The triggering of flip-flop 30 enables OR gate 35 which then commences a second timing interval to enable the particular test to be performed. The output of OR gate 35 as shown is connected to the timer 25 and, for example, may activate the timer to proceed to implement another timing interval. When the timer 25 has completed its initial interval, say for two seconds, the one shot 32 is triggered. Triggering of the one shot 32 also directs the pulse to amplifier 41, which amplifier energizes the speaker 40 to enable an audible tone to be heard by the user.

This audible tone indicates that the hold-down function mode has been implemented by the requisite depression of key 1. The user may release the key, at which point the one shot 26 will reset the timer and the timer will commence the second timing interval due to the fact that gate 35 has been activated. The second timing interval, which may be another timing interval, terminates by the transmission of a pulse, which pulse is received by gate 36 at one input and having its other input energized by OR gate 35. Thus an output pulse is produced at gate 36 at the end of the second timing interval. This output pulse triggers one shot 37, which one shot then proceeds to reset the timer 25 as well as flip-flip 30.

Hence, as will be seen, the flip-flip 30 in the case of the above-noted example remains on during the second timing interval and has its output connected to the intrusion system 15 to implement, for the example given, the standby battery test mode.

Figure 2:
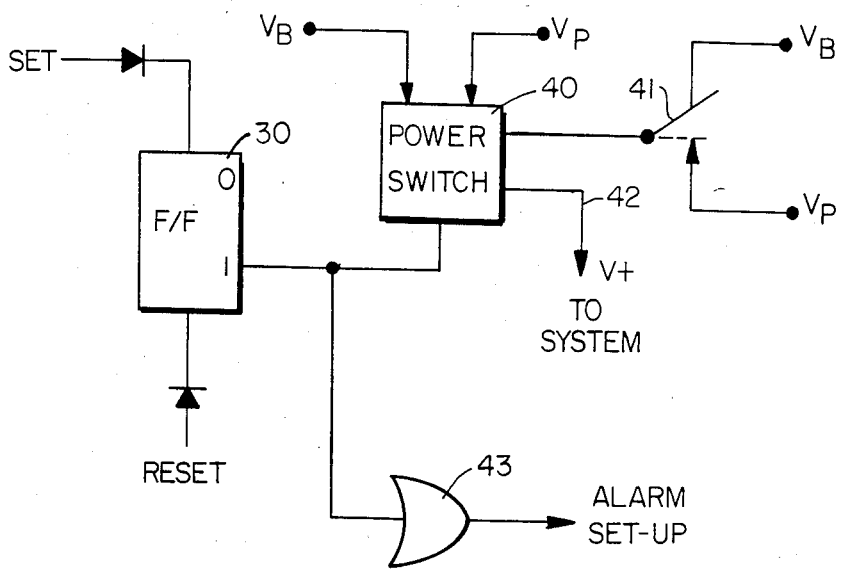
FIG. 2 is a block diagram depicting the activation of an intrusion system in a mode selected by holding down a given key.

Referring to FIG. 2, there is shown an example of how the standby battery mode is implemented by the triggering of flip-flop 30. As indicated, in most intrusion detection systems there is a source of voltage which is derived directly from the AC line and which voltage is generated by a typical power supply circuit designated as VP. This voltage VP is available as long as AC power is on. In any event, if AC power is shut off or disrupted, a power switch 40 will transfer the voltage to the system from VP to VB. VB is derived from a battery. The power switch 40 operates the transfer through a switching circuit such as a relay contact or a silicon controlled rectifier or other switching device 41 such that upon the loss of voltage VP battery voltage, VB is supplied to the system. The output lead 42 thus always has an operating potential on it which is either potential VB or VP to enable the intrusion detection system to operate during AC power failure.

Upon triggering of flip-flop 30, the power switch 40 is automatically switched from the VP to the VB position as shown by contact 41 accessing battery voltage VB. At the same time gate 43 is activated to send an alarm condition to the system. This alarm condition merely places an open or a short on a suitable test lead which generates an intrusion condition. Thus, the intrusion system which is now battery operated will produce an alarm due to the activation of gate 43. This alarm will result in the system's general alarm being heard as powered by the battery VB.

As indicated above, if no alarm sound is heard, or if the alarm sound is weak, the battery may need to be recharged or replaced. As can be seen at the termination of the second interval, the one shot 37 resets flip-flop 30, and hence would reset the power switch 40 and place the system in a normal operating mode. It is of course further understood that the system provides logic which prevents interference with the hold-down operation. For example, the normal use of the keypad 11 is for a user to key in a secret number. This is done rapidly, as for example with the same speed as dialing a telephone.

During the normal key-in use of the secret number, the keyed-in digits are normally stored by the intrusion detection system in a decode circuit, which decode circuit 50 is part and parcel of the intrusion detection system 15. The decode circuit compares the keyed-in digits with stored digits which may, for example, be stored in a system memory such as Read Only Memory (ROM) or a Programmable Read Only Memory (PROM).

Thus, as a user utilizes the keypad 11 to key in digits, gate 24 will be activated but the gate will produce a series of pulses at the output. Each of the pulses produced will trigger the one shot 26 which keep on resetting the timer 25 as well as the fact that the release of the keys will also stop the counter. The last pulse will produce the necessary transition to also trigger the one shot 26 and hence prevent timer 25 operation during the normal keying in of the system secret number during the arming and disarming intervals.

There are, of course, numerous ways of implementing such circuitry in regard to the hold-down operation. It is, of course, understood that while the digit key 1 indicates a hold-down function which essentially is a standby battery test, other digits keys such as 2, 3, 4, 5 and so on may perform other test functions. For example, the holding-down function implemented by the digit key 2 may allow the user to digitally display the numbers of all zones which are not shunted or all zones which have been previously inactivated. Such systems allow for this type of information to be displayed. Any operation can be performed on the intrusion detection system by utilizing the above-described hold-down key function.

As indicated above, every key on the keypad can serve a dual function. Hence, by holding down a key for a predetermined time interval, the user will hear a given bleep at the end of the interval. This bleep or sound which emanates from speaker 40 informs the user that the hold-down function has been accessed. Upon accessing the hold-down function, a second timing interval is implemented which allows the intrusion system, based on the triggering of the appropriate flip-flop, to implement the test procedure associated with the particular digit key.

Hence the above-described system provides the above-noted test features which enables the user greater versatility and flexibility in operating the system and without any substantial increase in cost or complexity. It is, of course, indicated and should be understood that the hold-down feature as above described may be associated with additional logic which is not shown but in any event should be apparent to one skilled in the art.

If more than one key is held down, for example assume a user decides to hold down keys 1 and 2, the holding-down of keys 1 and 2 will also start the above-described sequence in operation.

However, additional logic circuitry is included which for example may include a series of AND gates, all of which monitor the outputs of flip-flops 30 to 31. These AND gates will produce a signal if more than one flip-flop is triggered. This signal will then be used to reset the flip-flops, the timer, and to hold the timer 25 reset until a single key has been depressed. Logic circuits for implementing such functions are well within the knowledge of one skilled in the digital art.

It is also understood that many intrusion detection systems operate in conjunction with microprocessors which essentially perform all the necessary logic operations associated with such systems. It is expressly understood that the above-noted system operation can be implemented very simply by utilizing a microprocessor and programming the microprocessor in proper sequence. Hence, the microprocessor is associated with a program which includes a series of program flags. These flags are inserted by the programmer to implement certain programming functions. Thus, in implementing a hold-down function, the microprocessor would have access to all keys. The microprocessor normally can decode secret codes and compare the keyed-in digits from the keypad 11 with codes stored in microprocessor memory to enable the user to arm or disarm the system.

In any event, the microprocessor has access to all key inputs from keypad 11. Hence, during a hold-down function the microprocessor would implement a special routine. First, the microprocessor would make a determination as to whether a button is depressed. If a button is depressed, it would then set a flag indicating that the button has been depressed and that a hold-down mode might occur. The microprocessor will then place the digit associated with the held-down key in memory and store the digit.

The microprocessor will then commence a two second timing cycle which is analogous to the cycle provided by timer 25. At the end of this two second timing interval, the microprocessor will check to see whether the same key has been depressed and continues to be depressed. If the key has been depressed, the microprocessor will then via the program give the appropriate audible beep which will be sent at an output line from the microprocessor to the speaker.

Upon generating the audible beep, the microprocessor having the number of the stored key in memory will then implement the given routine such as the standby battery test routine as described above or any other routine desired in conjunction with the hold-down function key depressed.

Thus, it should be apparent that the above-described operation can be implemented in many ways by many different types of circuitry, as well as by a microprocessor, and all such alternatives are deemed to be encompassed within the spirit and scope of the claims as appended hereto.

What is claimed is:

1. A key hold-down apparatus for use in an intrusion detection system of the type employing a keypad consisting of a number of activatable keys for keying in information to said system indicative of a code for arming or disarming said system, the combination therewith comprising:

timing means coupled to said keys and operative to commence a predetermined timing cycle upon depression of any one of said keys, means coupled to said timing means and responsive to the termination of said timing cycle to provide an indication of the same, logic means coupled to said timing means and responsive to the termination of said timing cycle to provide an output control signal indicative of the key depressed and including means responsive to said control signal to activate said intrusion system to operate in a mode determined by said depressed key.

2. The key hold-down apparatus according to claim 1, wherein each of said keys is a momentary operated switch.

3. The key hold-down apparatus according to claim 1, wherein said timing means includes gating means having a plurality of inputs, with each input associated with one of said keys and operative to provide an output signal upon the depression of any one of said keys.

4. The key hold-down apparatus according to claim 3, wherein said timing means further includes a timing counter coupled to said gating means and responsive to said output signal to commence said timing cycle.

5. The key hold-down apparatus according to claim 1, wherein said indication provided is an audible signal.

6. The key hold-down apparatus according to claim 1, wherein said predetermined timing cycle is selectable between 2 to 5 seconds.

7. The key hold-down apparatus according to claim 1, further including means responsive to the release of one of said keys within said timing interval to reset said timing means.

8. The key hold-down apparatus according to claim 1, wherein said logic means further includes an actuatable memory device coupled to each key and responsive to said output control signal to store a value indicative of the depression of said any one key for said predetermined timing cycle.

9. The key hold-down apparatus according to claim 8, wherein said actuatable memory means includes a flip-flop.

10. The key hold-down apparatus according to claim 1, wherein said means responsive to said control signal includes means coupled to said timing means to initiate another timing cycle of a second period sufficient to operate said intrusion system in said mode, and reset means coupled to said timing means and responsive to the termination of said second period to reset said timing means.

11. A method of providing a hold-down function for an intrusion system of the type employing a keypad having a plurality of activatable digit keys, comprising the steps of:

timing the activation of one of said keys during a predetermined interval, storing the identity of said depressed key, providing an output indication indicative of the depression of said key during said interval, placing said intrusion detection system in a given operating mode upon receipt of said output indication with said mode determined according to the identity of said activated key as stored.

12. The method according to claim 11, wherein the step of placing said intrusion detection system in said given operating mode further includes the step of, commencing another timing cycle upon providing said output indication of a duration capable of allowing said system to provide said mode.

13. In an intrusion detection system of the type employing a keypad consisting of a plurality of activable keys used for keying in information to said system indicative of a code for arming or disarming said system, the combination therewith of apparatus for providing a dual use for any one of said keys by operating any one of said keys in a hold-down mode whereby said key is activated for a prolonged period, comprising:

timing means responsive to the operation of any one of said keys to provide a predetermined timing interval, actuatable storage means associated with each separate key and operative when activated to store an indication of which key was operated, means coupled to said timing means and operative to provide an output indication when said predetermined timing interval has transpired, means responsive to said output indication to actuate said storage means associated with said operated key to cause said storage means to store said indication, means for applying said stored indication to said intrusion detection system to cause said system to operate in a given mode as selected by said key being operated during said predetermined timing interval.

14. The intrusion detection system according to claim 13, wherein each of said keys are momentary contact keys.

15. The intrusion detection system according to claim 14, wherein said timing means includes gating means having a plurality of inputs with each input coupled to an associated key to provide an output signal indicative of any one key being operated and a timing counter coupled to the output of said gating means to provide said predetermined timing interval.

16. The intrusion detection system according to claim 14, wherein said actuable storage means includes a separate actuatable flip-flop for each of said keys wherein actuation of one of said flip-flops occurs for operation of one of said keys.

17. The intrusion detection system according to claim 14, further comprising:

resetting means coupled to said timing means and operative to reset said timing means upon a release of any of said operated keys during said timing interval.

18. The intrusion detection system according to claim 14, wherein said output indication is an audible tone.

19. The intrusion detection system according to claim 14, wherein said predetermined timing cycle is selectable between 2 to 5 seconds.

20. The intrusion detection system according to claim 13, wherein said system is operated in the standby battery test mode.

* * * * *